United States Patent [19]

Oetiker

[11] 4,050,154

[45] Sept. 27, 1977

[54] PERFORATING TOOL

[76] Inventor: Hans Oetiker, 21 Oberdorfstrasse, Horgen, Switzerland

[21] Appl. No.: 689,048

[22] Filed: May 24, 1976

[51] Int. Cl.[2] ..... B26F 1/00

[52] U.S. Cl. ..... 30/363

[58] Field of Search ..... 30/363, 360

[56] References Cited

U.S. PATENT DOCUMENTS

| | | | |
|---|---|---|---|
| 26,940 | 1/1860 | Wheeler | 30/363 |
| 503,109 | 8/1893 | Davis et al. | 30/363 |
| 548,547 | 10/1895 | Hood | 30/363 |
| 600,587 | 3/1898 | Low | 30/363 |
| 665,052 | 1/1901 | Bernard | 30/363 |
| 1,496,748 | 6/1924 | Stengel | 30/363 |
| 1,674,844 | 6/1928 | Spengler | 30/363 |
| 1,750,929 | 3/1930 | Griswold | 30/363 |
| 2,085,079 | 6/1937 | Broadwell | 30/363 X |

FOREIGN PATENT DOCUMENTS

| | | | |
|---|---|---|---|
| 833,929 | 3/1952 | Germany | 30/363 |
| 665,308 | 1/1952 | United Kingdom | 30/363 |

*Primary Examiner*—James L. Jones, Jr.
*Assistant Examiner*—J. T. Zatarga
*Attorney, Agent, or Firm*—Craig & Antonelli

[57] ABSTRACT

A tool is provided for perforating a clamping band or the like of the type which has a plurality of evenly spaced apertures for accommodating connection of the band with barb members on clamp locking apparatus. The perforating tool includes a pair of levers pivotally connected for movement about a common axis and including plier-like manually engageable handles protruding from the common pivot axis. At the opposite side of the common pivot axis from the handles, the levers pivotally support respective rigid perforating tool blocks. One of these perforating tool blocks carries a male perforating plunger and the other of these blocks includes an opening for linearly guiding the plunger, as well as a support for a band being perforated. In order to accommodate linear movement of the plunger and guide opening during pivotal movement of the handle levers, the perforating tool blocks are guided at respective guide pins extending through the respective levers. A spring-loaded band stop pin is provided for indexing the apertures in the band. This band stop pin is detachably mounted at the tool block holding the female die in such a manner as to accommodate changing of the tool from left to right-hand operation merely by changing the band stop pin support. To accommodate ready disassembly of the device and exchange of the perforating tool blocks, the same are connected to the levers by detachable pivot pins and the blocks are guided linearly at the levers along open slots in the blocks, so that, with removed pivot pins, the blocks can be removed and exchanged without requiring disassembly of the levers with respect to one another.

25 Claims, 7 Drawing Figures

PERFORATING TOOL

BACKGROUND AND SUMMARY OF THE INVENTION

The present invention relates to a perforating tool, especially for perforating steel bands and the like used to form hose clamps and the like. My earlier U.S. Pat. Nos. 3,523,337 and 3,579,754 disclosed clamping devices which included steel bands having a plurality of regularly spaced apertures formed therein. These apertures serve for the purpose of accommodating barb members on a tightening device of the clamp, whereby the band could be tightened and maintained in a tightened condition on a base. FIG. 1 of this application schematically depicts the clamping band of my invention disclosed in U.S. Pat. No. 3,579,754.

For mass produced clamps with perforated bands, it is quite efficient and economical to perforate the bands on large fixed perforating machines. It has also been contemplated to produce a perforated band in long strips which can later be cut up into smaller portions to form individual clamps. With this last-mentioned arrangement, it is possible to tailor make bands to the desired end usage, provided one has the locking apparatus such as shown in my above-noted patents.

However, there occurs situations in usage of this type of clamp, wherein it would be more advantageous if the clamping band included apertures only along a certain portion of the length thereof. For example, it will be readily understood that the strength of the band could be impaired by the inclusion of apertures around the entire periphery, especially if there are any inconsistencies in the construction of the band and/or the construction of the apertures along the length thereof. Also, if portions of the length of the band are to perform any type of sealing function or housing function, it would be desirable not to have apertures therealong.

Another important advantage of having apertures only at the end portion for engagement with the clamping devices is that a much stronger clamping effect can be obtained. If the band is perforated along its length (circumference of the band), the rubber or other material being clamped is pressed outwardly into the apertures so as to act as a brake preventing circumferential adjustment of the clamp portions, with consequent reduction in the clamping effect of the clamp. With the present invention, it is possible to selectively perforate the band only at the end portions, to accommodate the clamping devices, and thereby avoid the just-noted disadvantageous effects of hose material being pressed radially outwardly into the perforations along the circumference of the band.

There are also instances where it would be more economical to stock a small supply of unperforated band material, for use in making perforated aperture clamps of the above-described type, as well as for other usages. Heretofore, it has been impractical for small maintenance shops, gas stations, farms and the like to utilize stock flat band material for making hose clamps and the type on a small unit volume because of the expense and complexity of the band perforating equipment required. Especially in instances where remote field application of hose clamps and the like are required, such as in emergency automobile and truck repairs where it is uneconomical, and, in some instances practically impossible, to transport the vehicle back to a large repair shop, it would be desirable to have a portable tool which could facilitate construction of hose clamps, such as radiator hose clamps, to whatever desired configuration required.

Although makeshift perforating apparatus could be used to form perforated bands, such as hammer and punch arrangements, there are many drawbacks to the known perforating devices with respect to ease of operation, operator safety, reliability, repeatability of the desired aperture pattern, and the like.

Accordingly, the present invention contemplates filling the above-noted needs and overcoming the above-noted disadvantages of prior arrangements by providing a manually operable perforating tool which is easy to operate, maximizes safety for the operator, assures proper alignment and positioning of the apertures being made, and provides for simple interchangeability of the perforating tool parts. The interchangeability of tool parts is especially advantageous for the use of interchangeable tool dies to accommodate changes of the aperture size and geometric configuration, without requiring a new basic tool.

According to preferred embodiments contemplated by the present invention, a tool is provided which includes a first movable lever, a second movable lever, first and second perforating tool means supported at said levers and being movable with respect to one another, said first tool means including a perforating plunger movable therewith, said second tool means including guide means for guiding movement of said plunger, and band support means carried by one of said tool means and including a support surface for supporting a band during perforating movement of an end portion of said plunger through said band during movement of said first and second levers with respect to one another. According to a further feature of preferred embodiments of the invention, the tool means are constructed as rigid tool blocks pivotally supported at the levers for relative movement with respect to the levers in such a manner that pivotal movement of the levers effect a relative linear movement of the plunger and female perforating tool support die which supports the band during perforation operations. It is further contemplated for preferred embodiments of the invention that the levers be plier-like levers operable by one hand of an operator, whereby the tool can be held and operated with one hand while the other hand places the band strip in position on the tool for forming the apertures.

According to another feature of preferred embodiments of the invention, band stop pin means are provided for indexing and positioning the band with respect to the perforating plunger, whereby a repetitive reliable pattern of apertures can be formed in the band. In preferred embodiments, the stop pin is configured to have a diameter corresponding to the width of the plunger, whereby the band is maintained in a fixed correct axial position once the plunger is in an already formed aperture. In preferred embodiments, the stop pin is spring biased into position so as to accommodate movement of the band through the tool to the desired positions for forming apertures.

According to other important features of the present invention, preferred emobidments are constructed so as to accommodate disassembly of the tool and an exchange of the tool die blocks, without requiring disassembly of the basic plier-like lever construction. In preferred embodiments, the perforating plunger is carried by a first rigid tool block which is pivotally connected to a first lever of the tool at a pivot axis spaced from the common lever pivot axis, while the female die portion, as well as the plunger guide portion and support surface for the band are formed at a second rigid tool block, which is pivotally connected to the other of the levers.

Preferred embodiments also include guide pin means at the levers engageable in open guide slots of the respective tool block that are pivotally connected to the other of the levers, so as to axially guide and control the movement of the tool blocks during the pivotal movement of the levers. It is also contemplated in preferred embodiments to include enlargements at the common lever pivot axis engageable in semi-cylindrical recesses of the tool blocks for aiding and guiding the movement of the tool blocks during perforating operations, as well as also permitting ready disassembly of the tool blocks.

Preferred embodiments of the invention are constructed so as to accommodate switching to between right and left hand operation of the perforating tool, merely by removing a detachable support for the band stop pin and attaching it to the other side of the female tool block.

Further, according to preferred embodiments of the invention, the pivotal connection of the tool blocks to the plier-like levers is at a position spaced oppositely of the lever pivot axis with respect to the handles of the tool by a predetermined distance assuring a large mechanical advantage or increase of the manual force applied at the levers when transferred to the tool blocks.

In preferred embodiments of the invention, spring means are provided intermediate the lever handles for holding the same in spaced relationship corresponding to a non-perforating position of the tool, whereby one need only squeeze the levers together to perform a perforating operation.

It is also contemplated by the present invention to include embodiments with differently configured male and female die blocks, so that the same plier-like tool can be used for different sizes and shapes of band apertures, as desired.

In preferred embodiments, the perforating plunger is carried by one of the tool blocks by way of a simple T-shaped recess, whereby disassembly of the plunger with respect to said tool block can be accomplished merely by lifting the plunger laterally of the recess. In this manner, the plunger can be readily exchanged and removed for sharpening, replacement and the like. Also, with this configuration, the tool block for the plunger need not be exchanged, but merely the plunger itself need be exchanged when the female die opening is changed for accommodating a different aperture configuration.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE DRAWINGS

Figure 1:
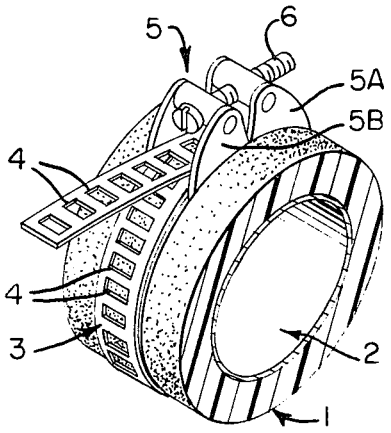
FIG. 1. (PRIOR ART)
FIG. 1 is a perspective view of a prior art clamping device, which includes a perforated flat steel band of the type with which the tool of the present invention is concerned.

Throughout the drawing figures, like reference numerals are used to depict like structure.

FIG. 1 illustrates a prior art compression band or clamping device arrangement of the type contemplated for use with the perforating tool of the present invention. Reference numeral 1 generally designates therein an object such as a plastic hose or the like which is intended to be tightly clamped over a fixed metallic part generally designated by reference numeral 2 which may be, for example, a nipple or pipe. A perforated band 3 is provided which includes a plurality of approximately rectangular apertures.

The ends of the band 3 are tightened over the hose 1 by means of a closure mechanism generally designated by reference numeral 5 which consists of two parts, namely of the one closure part 5, which includes parts 5A and 5B which are held together and tightened by means of a machine screw 6. Each of the parts 5A and 5B include side wall portions bent up at substantially right angles from the center bottom portion. The bottom portion may be slightly curved in the circumferential direction of the band in anticipation of the curvature of the object on which they are to be ultimately mounted but are substantially flat in a plane perpendicular thereto. Part 5A is provided with radially outwardly extending bent up portions, hooks, or barbs (not shown) which engage in a corresponding number of apertures 4 of the band 3. The other part 58 includes a pin around which the band is bent back to hold the same in place. As can be readily understood, with the band 20 attached to each of the respective parts 5A and 5B, a tightening of the screw 6 results in a tightening of the band about the hose. FIG. 1 and the description thereof are only included herein as exemplary of the type of clamps, with which perforated bands can be used.

Figure 2:
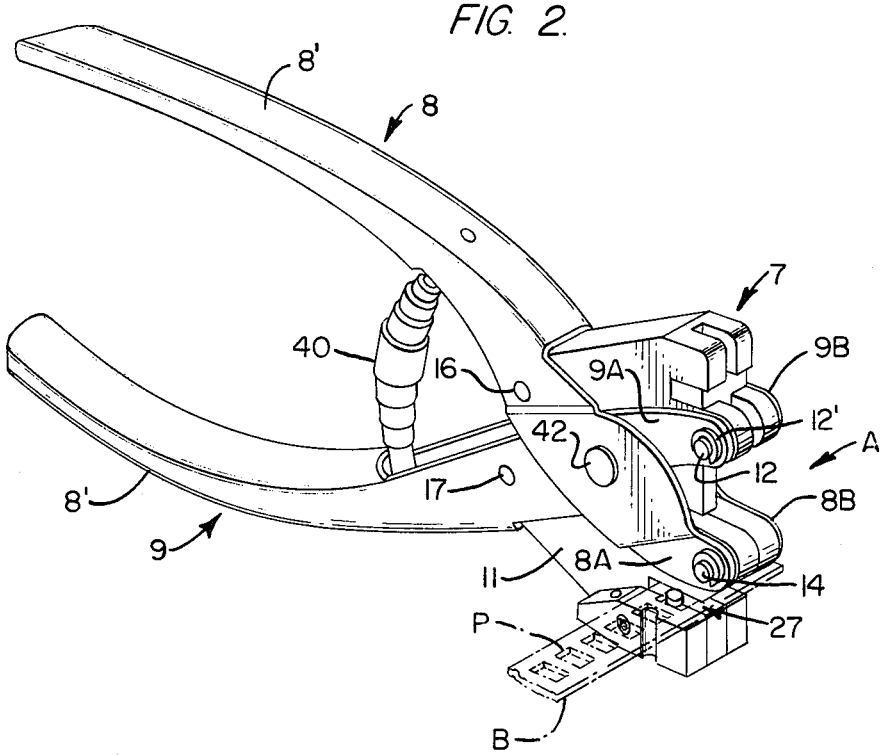
FIG. 2 is a partial perspective view of the novel perforating tool constructed in accordance with the present invention, and showing a steel band being perforated.
Figure 3:
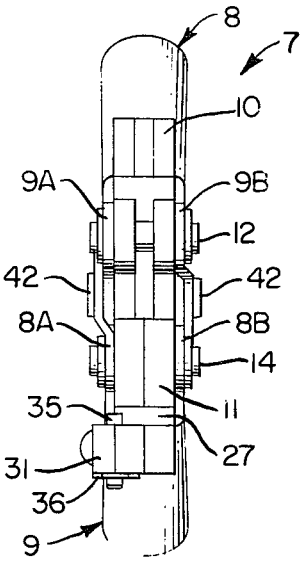
FIG. 3 is a partial-schematic end view taken in the direction of arrow A of FIG. 2.
Figure 4:
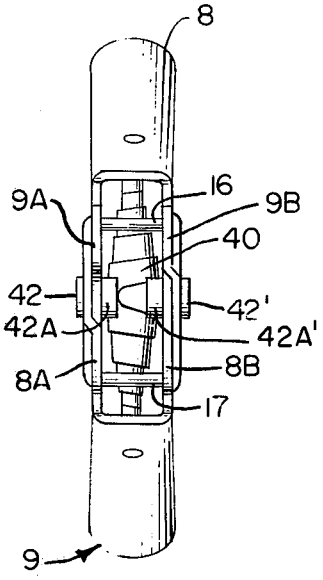
FIG. 4 is an end view similar to FIG. 3, however with the tool blocks removed for purposes of illustration of the tool construction other than these tool blocks.

FIG. 2 is a perspective view showing the novel clamping tool 7 constructed in accordance with the present invention. Tool 7 includes a first lever 8 and a second lever 9 which are pivotally connected to one another by pivot pins 42, 42'. Lever 8 includes two spaced side walls 8A and 8B which are formed as extensions of the handle portion 8'. In a like manner, lever 9 includes side wall portions 9A and 9B extending rigidly from handle portion 9'. Intermediate the respective side walls 8A, 9A, 8B, 9B are disposed a first female took block 11 and a second male tool block 10. Tool block 10 is pivotally mounted at lever 9 by way of pivot pin 12 extending through aperture 13 of block 10. Block 11 is pivotally connected to lever 8 by way of pivot in 14 extending through aperture 15 of block 11.

Figure 5:
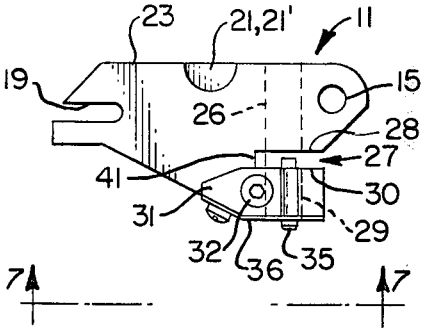
FIG. 5 is a side view of the female die block of the invention depicted in FIG. 2.
Figure 6:
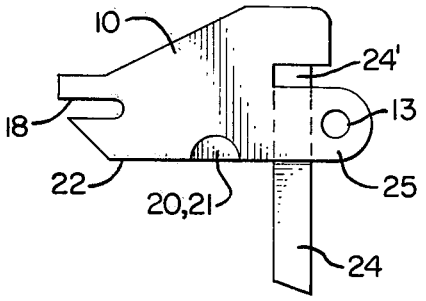
FIG. 6 is a side view of the male die block and plunger of the tool of FIG. 2.
Figure 7:
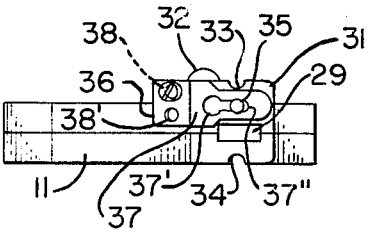
FIG. 7 is a partial view of the female die block taken in the direction of line 7—7 of FIG. 5.

A fixed pin 16 extends between side walls 8A and 8B of lever 8. In a similar manner, a fixed pin 17 extends between side walls 9A and 9B of lever 9. Tool block 10 is provided with a slot 18 at its leftward end as shown in FIG. 6, which slot 18 is guidably disposed over pin 16. In a like manner tool block 11, at the left side thereof as shown in FIG. 5, includes a slot 19 which guidably engages over pin 17. The distance between the respective pins 16 and 17 and the common pivot pin 42, 42' as well as the distance between the pins 12 and 14 with respect to said common pivot pins 42, 42' are constructed substantially equal so as to result in linear movement of tool blocks 10 and 11 toward one another upon pivotal movement of lever handles 8', 9' toward one another.

To assist further in guiding and maintaining the tool blocks 10 and 11 in position, tool block 10 is provided with semi-cylindrical recesses 20, 20' at respective opposite sides thereof, while tool block 11 is provided with similar semi-cylindrical shaped recesses 21, 21' at respective opposite sides thereof. These recesses 20, 20', 21, 21' conform to cylindrical enlargements 42A on pin 42 and enlargement 42A' on pin 42' when the tool is in a completely closed position with levers 8' and 9' maximally close to one another, and correspondingly also block 10 and 11 having their faces 22 and 23 respectively abutting one another.

Tool block 10 carries a separate perforating plunger 24 in a T-shaped slot thereof (in FIG. 6, 24' indicates one wing of the T-shaped end of plunger 24). Block 10 is configured with an open slot extending inwardly from the rightward end through portion 25, so as to accommodate insertion and removal of plunger 24, by merely moving plunger 24 to the right and left as shown in FIG. 6. It will be understood that plunger 24 is maintained in position, in use, by being slidably guided in the guide aperture 26 of tool block 11.

Tool block 11, as best shown in FIG. 5, includes a milled in rectangular shaped slot 27 which extends completely through the tool block 11 in a direction perpendicular to the plane of FIG. 5 for accommodating extension therethrough of the band B being perforated with perforations P. Tool block 11 also includes a thru aperture 29, aligned with guide aperture 26, for accommodating passage of the end portion of the plunger 24, as well as for discharge of the punched out portions of the band B. The side wall surface 30 at the bottom of slot 27 as shown in FIG. 5, provides, in conjunction with aperture 29, the female cutting die which cooperates with the plunger 24 during perforation of the band B.

A band stop guide block 31 is detachably attached to tool block 11 by way of screw 32. This stop guide block 31 includes semi-cylindrical recesses 33 extending in a direction parallel to the travel path of the plunger 24. These recesses 33, together with correspondingly formed semi-cylindrical recesses 34 at the tool block 11, slidably accommodate a stop pin 35. This stop pin 35 has a diametric dimension corresponding to the width of the apertures P being formed, and, in use, is engageable in a previously formed aperture, or at the extreme end of the band, so as to accurately position the band for the formation of further apertures. The exact dimensioning and positioning of the stop pin and the stop guide block will, of course, depend upon the desired aperture configuration and spacing.

The band stop guide pin 35 is spring biased into the slot 27 by way of flat spring member 36. Spring member 36 includs a slot 37 having a wide portion 37' and a narrow portion 37''. The wide portion 37' accommodates placement of the spring 37 over the enlarged head 35' of the pin while the small portion 37' of the slot accommodates engagement in a groove formed between the portion 35' and the shank of the pin 35, whereby the spring 37 holds the pin for both directions of movement. The spring 37 is symmetrically constructed with a pair of apertures 38, 38' for accommodating attachment screw 39, to attach the same at respective different mirror-image positions on the stop guide block 31. With this construction, as well as the symmetrical construction of the recesses 33, 34, the tool can be switched from right-hand to left-hand operation by merely moving the stop guide block 31 and pin 35, along with a switching of the positions for the mount of the spring 37 at the guide block 31. The remaining structure of the tool can remain unchanged for this switching from right to left-hand operation.

Reference numeral 40 designates a spring which continuously biases the lever handles 8', 9' away from one another.

Although the operation of the perforating tool of the present invention should be readily understood from the above description, following is a brief explanation of a perforating operation with the perforating tool of the present invention.

Assuming that the tool is in the fully assembled condition as shown in FIG. 2, one need merely insert the end of an unperforated band B into the slot 27, until proper abutment against the back wall 41 of the slot 27, as well as with the stop pin 35 is obtained. With the band in this position, one need merely squeeze the levers 8', 9' toward one another and the plunger 24 will extend through the apertures 26, across the slot 27 through the band B and partially into the open aperture 29 to thereby form a perforation aperture P in the band B. The blank portion cut out of the band B can then pass through the lower portion of aperture 29 (FIG. 5). Further perforation apertures can be performed in a similar manner, utilizing the stop guide pin 35 in engagement with one of the previously formed apertures to accurately position and space the apertures with respect to one another along the length of the band. In this connection, it is not necessary to concern oneself with the axial positioning of a first formed aperture along the band B, since, after the formation of such an aperture, one can cut of the remaining portion of the band and then use the first aperture as a guide for forming the next aperture (utilizing stop guide pin 35), and so forth. With the types of clamping devices contemplated by the present invention, the stop guide pin arrangement of the present invention is particularly advantageous in that it is usually required to form a plurality of regularly spaced apertures in a band, in order for the clamping device to be connected. It will be readily understood that the length of the band, as well as the aperture perforation pattern can be varied at will, since one is working with a blank piece of band, with no constraints as to the end length, as long as it is sufficient to accommodate the clamping device.

When it is desired to change the tool blocks 10 and 11, for whatever purpose, including exchange of same, sharpening of the plunger tool and the like, one need only remove the pins 12 and 14, which are preferably advantageously connected by way of detachable connections such as open spring clip washers 12', 14', and then manually slip the two tool blocks 10 and 11 out of the recess formed by the facing side walls of the levers. Since the slots 18 and 19 are open in the direction toward the handle, and further since the recesses 20, 21',

21, 21' are also open toward the lever pivot pin enlargements 42A, 42A', it is unnecessary to disassemble the pins 16 or the pins 42, 42' to accommodate exchange of tool blocks. It one wants to further disassemble the male tool block 10, one need only then lift out the plunger 24 from its holding slot. Since the major lever connections of the tool need not be changed to accommodate changes in the tool blocks, a very reliable rigid construction of the basic plier can be made, while still having the advantages of ready rapid interchangeability of tool blocks so as to accommodate different shape and size apertures desired to be formed. It is contemplated that one purchasing the tool, would also purchase whatever number of spare and/or various size tool block configurations one contemplated using.

While I have shown and described one embodiment in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. A tool for perforating a clamping band or the like comprising:

a first movable lever, a second movable lever, lever pivot means for pivotally connecting said first and second levers to one another for pivotal movement about a common lever pivot axis, first and second perforating tool means supported at said levers and being movable with respect to one another, said first tool means including a perforating plunger movable therewith, said second tool means including guide means for guiding movement of said plunger along a predetermined plunger travel path, and band support means carried by one of said tool means and including a support surface of supporting a band during perforating movement of an end portion of said plunger through said band during movement of said first and second levers with respect to one another, said first tool means including a first rigid tool block which is pivotally connected to said first lever at a first tool block pivot axis, said second tool means including a second rigid tool block which is pivotally connected to said second lever at a second tool block pivot axis, said first and second tool block pivot axes being at one side of said predetermined plunger travel path and said common lever pivot axis being at the other opposite side of said predetermined plunger travel path.

2. A tool according to claim 1, wherein said guide means includes a guide opening in said second tool means, said guide opening being configured to slidably linearly guide said plunger.

3. A tool according to claim 1, wherein said first and second levers are connected at said common lever axis by common lever pivot pin means, wherein said first and second levers together form recesses in the area of said common lever axis for accommodating at least a portion of said tool blocks, wherein said common lever pivot pin means includes cylindrical enlargements at the ends thereof facing into said recesses, and wherein said tool blocks include respective semi-cylindrical shaped recesses guidably engageable with said cylindrical enlargements.

4. A tool according to claim 1, wherein said plunger is a rigid rod member which rests in a slot of said first rigid tool block.

5. A tool according to claim 4, wherein said rigid rod member is T-shaped and rests in a T-shaped slot of said first rigid tool block.

6. A tool according to claim 1, wherein said second tool block includes a band opening extending therethrough in a first direction for accommodating passage of a band and a plunger opening extending in a second direction perpendicular to said first direction for accommodating passage of said plunger end portion through said band.

7. A tool according to claim 6, wherein said band opening is constructed as an open slot, and wherein said plunger opening extends into a portion of said second tool block at the side of said slot furtherest from the first tool block.

8. A tool according to claim 7, wherein said plunger opening is axially aligned with a guide opening extending from said slot to the side of said second tool block facing said first tool block, said guide opening slidably guiding said plunger and forming said guide means.

9. A tool according to claim 1, wherein said levers include plier-like handle means which are manually movable by one hand.

10. A tool according to claim 9, wherein band stop means are provided on one of said tool means for holding the band in predetermined positions with respect to the travel path of said plunger, and wherein said tool, including said band stop means, is constructed to be readily converted between right and left hand operation configurations by way of detachment and attachment of said band stop means.

11. A tool according to claim 10, wherein said tool is symmetrically constructed with respect to a plane bisecting both of said levers, except for said band stop means.

12. A tool according to claim 1, wherein said first lever includes a first block guide member slidably engaged in a block guide slot of said second tool block, and wherein said second lever includes a second block guide member slidably engaged in a block guide slot of said first tool block.

13. A tool according to claim 12, wherein said first block guide member is disposed at one side of said common lever axis and said first tool block axis is disposed at the other side of said common lever axis.

14. A tool according to claim 13, wherein said tool blocks are conncted to said levers at said first and second tool block pivot axes by readily detachable tool block pivot pin means, and wherein said tool blocks and said block guide slots are configured to accommodate removal of said tool blocks from said tool without requiring movement of said lever pivot means and said block guide members from their respective in-use assembled positions.

15. A tool according to claim 3, wherein said first and second levers are connected to said common lever axis by common lever pivot pin means, wherein said first and second levers together form recesses in the area of said common lever axis for accommodating at least a portion of said tool blocks, wherein said common lever pivot pin means includes cylindrical enlargements at the ends thereof facing into said recesses, and wherein said tool blocks include respective semi-cylindrical shaped recesses guidably engageable with said cylindrical enlargements.

16. A tool according to claim 15, wherein said tool blocks are connected to said levers at said first and second tool block pivot axes by readily detachable tool block pivot pin means, and wherein said tool blocks and said block guide slots are configured to accommodate removal of said tool blocks from said tool without requiring movement of said lever pivot means and said block guide members from their respective in-use assembled positions.

17. A tool according to claim 1, wherein band stop means are provided on one of said tool means for holding the band in predetermined positions with respect to the travel path of said plunger.

18. A tool according to claim 17, wherein said band stop means includes a band stop pin engageable with one of a previously formed aperture and an end of said band when said band is in a proper position for forming an aperture.

19. A tool according to claim 18, wherein said band stop pin is spring biased into an opening of said tool which accommodates passage of a band during perforating operations.

20. A tool according to claim 19, wherein said band stop pin is supported at said second tool means by way of a flat spring clip, said spring clip engaging in a shoulder formed on said band stop pin.

21. A tool according to claim 20, wherein said spring clip is detachably connected to a rigid stop block, said rigid stop block being detachably connected to said first rigid tool block.

22. A tool according to claim 51, wherein said stop block and said first tool block include mating recesses for accommodating said band stop pin.

23. A tool according to claim 22, wherein said tool block and said stop block includes means for accommodating placement of said stop block and band stop pin at either side of the tool block, whereby the tool can be readily switched from right hand to left hand operation merely by moving the stop block, the band stop pin and the flat spring.

24. A tool according to claim 23, wherein said band support means includes means for preventing placement of operators finger or fingers in the path of the plunger during perforating operations with the tool.

25. A tool for perforating a clamping band or the like comprising:

a first movable lever, a second movable lever, first and second perforating tool means supported at said levers and being movable with respect to one another, said first tool means including a perforating plunger movable therewith, said second tool means including guide means for guiding movement of said plunger, and band support means carried by one of said tool means and including a support surface for supporting a band during perforating movement of an end portion of said plunger through said band during movement of said first and second levers with respect to one another, wherein band stop means are provided on said second tool means for holding the band in predetermined positions with respect to the travel path of said plunger, wherein said band stop means includes a band stop pin engageable with one of a previously formed aperture and an end of said band when said band is in a proper position for forming an aperture, wherein said band stop pin is supported at said second tool means by way of a flat spring clip, said spring clip engaging in a shoulder formed on said band stop pin, wherein said spring clip is detachably connected to a rigid stop block, said rigid stop block being detachably connected to a rigid tool block of said second tool means, said rigid tool block being pivotally connected to said second lever, wherein said stop block and said tool block include mating recesses for accommodating said band stop pin, and wherein said tool block and said stop block include means for accommodating placement of said stop block and band stop pin at either side of the tool block, whereby the tool can be readily switched from right-hand to left-hand operation merely by moving the stop block, the band stop pin, and the flat spring.

* * * * *

UNITED STATES PATENT OFFICE

CERTIFICATE OF CORRECTION

Patent No. 4,050,154 Dated September 27, 1977

Inventor(s) Oetiker

It is certified that error appears in the above-identified patent and that said Letters Patent are hereby corrected as shown below:

Column 7, line 41, as it now reads:

means and including a support surface of support-

Column 7, line 41, as it should read:

means and including a support surface for support-

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*